US007987550B2

(12) United States Patent
Nielsen

(10) Patent No.: US 7,987,550 B2
(45) Date of Patent: Aug. 2, 2011

(54) METHOD OF DETERMINING THE DEGREE OF FILLING OF THE DUST COLLECTOR OF A VACUUM CLEANER AND FILLING INDICATOR

(75) Inventor: Anders Hedelund Nielsen, København N. (DK)

(73) Assignee: Nilfisk-Advance A/S, Brondby (DK)

( * ) Notice: Subject to any disclaimer, the term of this patent is extended or adjusted under 35 U.S.C. 154(b) by 870 days.

(21) Appl. No.: 11/885,628

(22) PCT Filed: Mar. 3, 2006

(86) PCT No.: PCT/DK2006/000129

§ 371 (c)(1),
(2), (4) Date: Dec. 20, 2007

(87) PCT Pub. No.: WO2006/092147

PCT Pub. Date: Sep. 8, 2006

(65) Prior Publication Data

US 2008/0134461 A1 Jun. 12, 2008

(30) Foreign Application Priority Data

Mar. 3, 2005 (DK) ..... 2005 00320
Apr. 28, 2005 (DK) ..... 2005 00620

(51) Int. Cl.
*A47L 9/28* (2006.01)

(52) U.S. Cl. ..... 15/339; 15/347

(58) Field of Classification Search ..... 15/319, 15/347, 339; *A47L 9/28*
See application file for complete search history.

(56) References Cited

U.S. PATENT DOCUMENTS

| | | | | |
|---|---|---|---|---|
| 4,020,525 | A * | 5/1977 | Fromknecht et al. | 15/339 |
| 4,733,431 | A | 3/1988 | Martin | |
| 5,722,109 | A * | 3/1998 | Delmas et al. | 15/319 |
| 6,026,539 | A * | 2/2000 | Mouw et al. | 15/339 |
| 6,167,588 | B1 | 1/2001 | Dyson | |

FOREIGN PATENT DOCUMENTS

| | | |
|---|---|---|
| DE | 3300250 | 7/1984 |
| DE | 4323222 | 4/1995 |
| EP | 0615718 | 9/1994 |

OTHER PUBLICATIONS

English Abstract of EP 0615718.
English Abstract of DE 4323222.
English Abstract of DE 3300250.

* cited by examiner

*Primary Examiner* — David A Redding
(74) *Attorney, Agent, or Firm* — Dykema Gossett PLLC

(57) ABSTRACT

In order to measure the degree of filling of a dust collector (5), where the dust (15, 16) collected in the dust collector may be of a very varied composition ranging from very fine dust (15) to rather large particles (16), a high pressure difference and a low pressure difference are measured by two differential pressure meters (11, 12), where the one differential pressure meter (12) measures the pressure difference between the compartment (4) of the dust collector, in which the dust collector (5) is arranged, and a measurement position at the connecting stub (6) of the vacuum cleaner, as is known, while the other differential pressure meter (11) measures between two measurement positions inside the connecting stub (6). Hereby, the method and the filling indicator according to the invention will ensure that larger particles do not settle inside the connecting stub (6) since these are detected beforehand by the differential pressure meter (11) which records lower pressure differences that the differential pressure meter (12).

8 Claims, 1 Drawing Sheet

Figure 1:
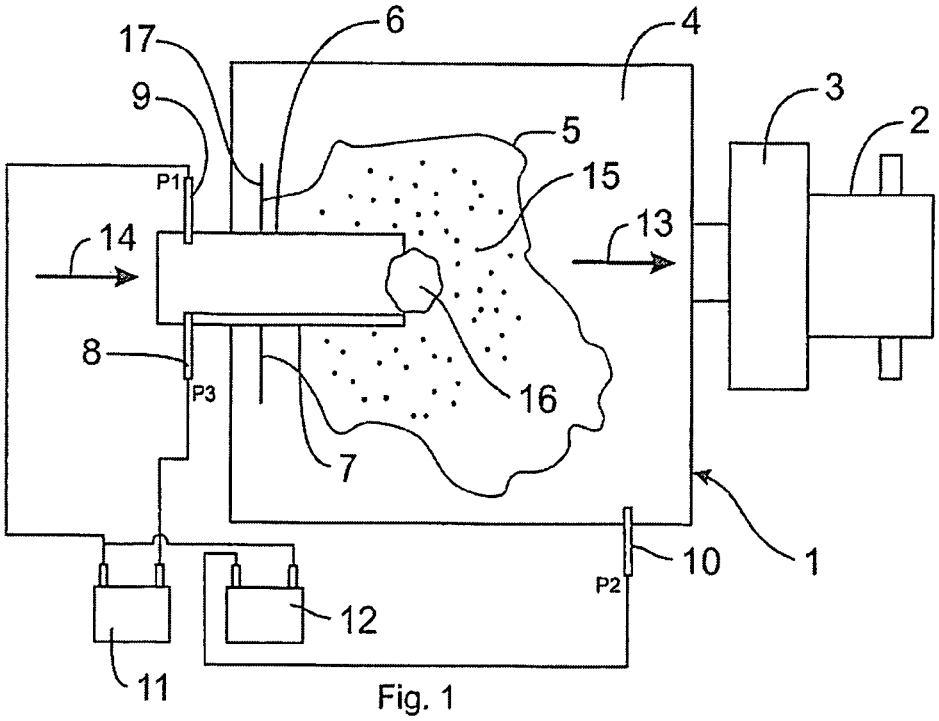

METHOD OF DETERMINING THE DEGREE OF FILLING OF THE DUST COLLECTOR OF A VACUUM CLEANER AND FILLING INDICATOR

The invention relates to a method of determining the degree of filling of the dust collector of a vacuum cleaner; said vacuum cleaner having a compartment for receiving the dust collector, said compartment having a connecting stub for receiving a vacuum cleaner hose, wherein a differential pressure between an area inside the compartment, but outside the bag, and an area inside the bag is measured.

The invention moreover relates to a filling indicator for determining the degree of filling of a dust collector, which is arranged in a compartment in the vacuum cleaner, said vacuum cleaner being connected with a connecting stub, wherein the degree of filling of the dust collector is determined by a differential pressure meter at two measurement positions where the one measurement position is positioned inside the compartment outside the bag, while the other measurement position is positioned inside the bag.

U.S. Pat. No. 4,733,431 discloses a vacuum cleaner which has three differential pressure meters to measure whether a bag is perhaps missing in the vacuum cleaner, or whether the bag has been filled or clogged in another manner, or whether there is an obstruction between: the mouthpiece of the vacuum cleaner and forwards to the connecting stub of the vacuum cleaner hose.

Measurement of the obstruction between the mouthpiece, the vacuum cleaner hose and the connecting stub is performed by means of a differential pressure measurement, where a pressure difference is measured between the pressure of the surrounding air outside the vacuum cleaner (the atmosphere) and the pressure at the outlet of the connecting stub near the inlet to the dust collector.

DE 43 23 222 describes a method of measuring the degree of filling of a vacuum cleaner bag, wherein two differential pressure measurements are performed. These differential pressure measurements provide their respective indications of the composition of sucked material, so as to allow it to be determined more precisely whether the vacuum cleaner bag is about to be clogged, no matter whether it is by fine dust or coarser, airy material.

In those cases where a bag is about to be filled, and slightly larger objects, such as popcorn or the like, are sucked up, they will not contribute to establishing any noticeable pressure drop which initiates a warning light indicating that the bag is filled.

In such a case, it will be possible for the material to get stuck in the connecting stub, in which sucked material originating from the bag, but also subsequently sucked material will accumulate quite rapidly.

Accordingly, an object of the invention is to provide a method and a filling indicator, where, in good time, a signal is emitted if there is a risk that material will accumulate in the connecting stub.

The object of the invention is achieved by a method of the type defined in the introductory portion of claim 1, which is characterized in that a further differential pressure is measured between a first area and, a second area in the connecting stub.

Hereby, sucked material which settles in the bag near the outlet of the connecting stub to the bag, will be detected.

Expediently, as stated in claim 2, the one area is disposed near the end of the connecting stub where it is passed into the dust collector, and the other area is disposed at a suitable distance inside the connecting stub relative to the said end of the connecting stub.

As mentioned, the invention also relates to a filling indicator.

This filling indicator is characterized in that a differential pressure meter with two measurement positions is additionally provided, where both measurement positions are positioned inside the connecting-stub.

To achieve a good sensitivity in the measurement, it is advantageous if, as stated in claim 4, the one measurement position is positioned in the connecting stub near the end of the connecting stub where it is passed into the dust collector, while the other measurement position is positioned at a distance from the one measurement position.

An expedient way of designing the differential measurements is, as stated in claim 5, that the other measurement position is common to the two differential pressure measurements.

In order to physically implement the invention, it is an advantage if, as stated in claim 6, inside the connecting stub, a pipe is arranged axially with the connecting stub, said pipe extending at its one end from the end of the connecting stub where it is passed into the dust collector, and being connected at its other end by a transverse pipe member, and, as stated in claim 7, that a transverse pipe member is additionally arranged in the connecting stub at a distance from the end where the connecting stub is passed into the dust collector.

Experiments have shown that an expedient length of the axial pipe is that the length of the axial pipe is at least 5 mm, preferably 50 mm, as stated in claim 8.

Figure 2:
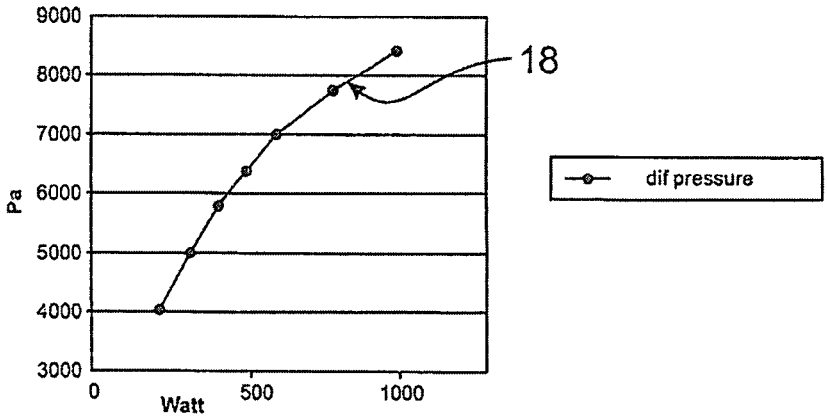
Figure 3:
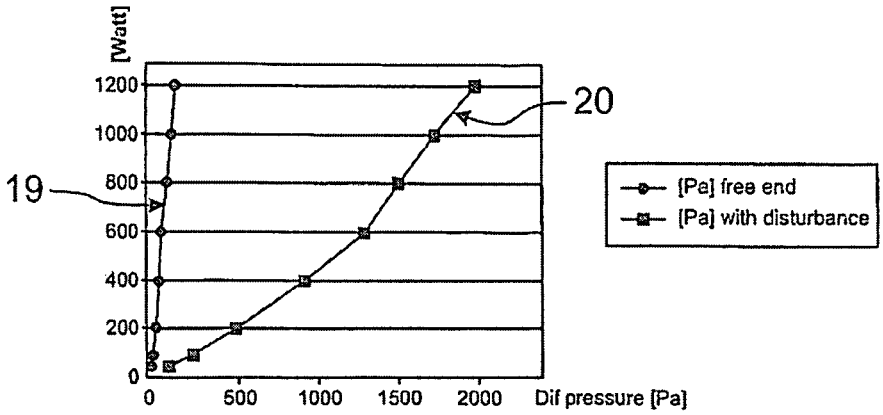

The invention will now be explained more fully with reference to the drawing, in which FIG. 1 schematically shows a vacuum cleaner with a filling indicator according to the invention, FIG. 2 shows a typical curve of the differential pressure in a dust collector which is filled as a function of the power fed to the vacuum cleaner, while FIG. 3 shows a typical curve of the differential pressure in a connecting stub, where no material has settled, and where material has settled in it.

In FIG. 1, the numeral 1 generally designates a vacuum cleaner shown schematically. The vacuum cleaner 1 is driven by a motor 2 and a blower 3 which provides a flow of air flowing from a vacuum cleaner hose (not shown) in the direction of the arrow 14 into the compartment 4 of the vacuum cleaner, in which a dust collector 5 is arranged, said dust collector being secured to a connection arrangement (not shown in detail) which is adapted to receive a plate 17 which forms part of the dust collector, as is well-known.

The term dust collector is taken to mean a vacuum cleaner bag, a dust compartment without a bag, a drop chamber, a part of a cyclone separating system or the like. The dust collector may be fitted in the vacuum cleaner itself or be arranged somewhere in the hose system.

As will be seen, a certain amount of dust 15, which may comprise fine and coarse dust, hair from dogs, etc., is collected in the dust collector. The vacuum cleaner hose (not shown) is connected with a connecting stub 6, through which blast air is conveyed into the dust collector and further out into the compartment in the direction of the arrow 13. A pipe is arranged in the connecting stub 6 axially therewith, said pipe extending in the entire length of the connecting stub. The axial pipe is connected with a shorter, transverse pipe 8 at the inlet to the connecting stub. A further transverse pipe 9 is arranged in the connecting stub 6. Finally, a pipe 10 is arranged in one of the walls of the compartment.

The numerals 11 and 12 designate differential pressure meters. The one differential pressure meter is connected with the two transverse pipes 8, 9 and is thus capable of measuring the pressure difference between the outlet of the connecting stub close to the dust collector and the inlet of the connecting stub. The other differential pressure meter is connected with the transverse pipe 9 and the pipe 10 in the wall of the compartment and is capable of measuring the pressure difference between the inlet of the connecting stub and the pressure inside the compartment 4.

The pressure differences which can thus be measured, are with the shown designations $P_t$=P3−P1, which is indicative of the pressure drop through the connecting stub, while $P_p$=P2−P1 is indicative of the pressure drop through the connecting stub and the bag.

FIG. 2 shows typical values of $P_p$ along the Y-axis in dependence on the power fed to the motor of the vacuum cleaner and with a given degree of filling and composition of dust in the dust collector. Of course, the curve will change as the contents of the dust collector change, since it will be shifted to the left in FIG. 2 with a greater degree of filling.

With reference to FIG. 1 again, the numeral 16 designates a slightly larger particle, e.g. a popcorn or another similar disturbance. Of course, several of these particles may be present in the dust collector. This particle will not contribute noticeably to the pressure drop which is measured with the differential pressure meter 12, as the resistance to the passage of air between the particles is not very great.

As the contribution from these particles is thus almost not recorded, it may happen that the dust collector becomes overfilled, and that these particles accumulate in the connecting stub 6, which is undesirable. With a view to avoiding this and recording that larger particles may get jammed in the connecting stub, the other differential pressure meter will record this.

As will be seen in FIG. 3, the numeral 19 designates a curve where there is virtually no pressure drop in the connecting stub, irrespective of the power applied to the vacuum cleaner.

If, on the other hand, one or more larger particles settle close to the outlet of the connecting stub, the pressure conditions will follow the curve 20 in FIG. 3, which shows a clearly increased differential pressure at given power feeds to the motor. With e.g. a power feed of 1000 W, the differential pressure will change from about 250 Pa to 1800 Pa, which may be utilized for activating an indicator (not shown), which indicates that the dust collector is to be replaced.

It is illustrated below by some numerical examples how the filling, indicator operates:

EXAMPLE 1

The vacuum cleaner is, provided with an empty dust collector and is fed with 1200 W, which gives the following values over the pressure indicator 11:

| | | |
|---|---|---|
| a) | Pressure difference without object: | 220 Pa |
| b) | Pressure difference with object: | 2100 Pa |

EXAMPLE 2

The vacuum cleaner is provided with an empty dust collector, and the power is regulated down from 1200 W to 600 W, which gives the following values over the pressure indicator 11:

| | | |
|---|---|---|
| a) | Pressure difference without object: | 90 Pa |
| b) | Pressure difference with object: | 1380 Pa |

EXAMPLE 3

The vacuum cleaner is provided with an almost filled dust collector and is fed with 1200 W, which gives the following values over the pressure indicator 11:

| | | |
|---|---|---|
| a) | Pressure difference without object: | 30 Pa |
| b) | Pressure difference with object: | 450 Pa |

EXAMPLE 4

The vacuum cleaner is provided with an almost filled dust collector, and the power is regulated down from 1,200 W to 600 W, which gives the following values over the pressure indicator 11:

| | | |
|---|---|---|
| a) | Pressure difference without object: | 5 Pa |
| b) | Pressure difference with object: | 5 Pa |

As will be seen, the pressure: indicator does not work with a completely filled dust collector and half power feed, which, however, in the normal use of a vacuum cleaner is a power feed which hardly occurs in such a case.

The invention thus provides the possibility of indicating whether a dust collector is to be replaced, irrespective of which material is present in the dust collector, as the degree of filling is determined by differential pressure meters which measure at high differential pressures, such as about 8000 Pa, and at low differential pressures, such as 2000 Pa.

The invention claimed is:

1. A method of determining the degree of filling of the dust collector (5) of a vacuum cleaner (1), said vacuum cleaner having a compartment (4) for receiving the dust collector, said compartment having a connecting stub (6) for receiving a vacuum cleaner hose, wherein a differential pressure, $P_p$=(P2−P1), between an area inside the compartment, but outside the bag, and an area inside the connecting stub is measured, wherein a further differential pressure, $P_t$=(P3−P1), is measured between a first area and a second area in the connecting stub.

2. A method according to claim 1, wherein the one area is disposed near the end of the connecting stub (6) where it is passed into the dust collector (5), and the other area is disposed at a suitable distance inside the connecting stub relative to the said end of the connecting stub.

3. A filling indicator for determining the degree of filling of the dust collector (5) of a vacuum cleaner (1) which is arranged in a compartment (4) in the vacuum cleaner, said dust collector (5) being connected with a connecting stub (6), wherein the degree of filling of the dust collector is determined by a differential pressure meter (12) at two measurement positions, where the one measurement position (P2, P3) is positioned inside the compartment (4) outside the bag (5), while the other measurement position is positioned inside the connecting stub (6), wherein a differential pressure meter (11) with two measurement positions (P1, P3) is additionally provided, where both measurement positions are positioned inside the connecting stub (6).

4. A filling indicator according to claim 3, wherein the one measurement position (P3) is positioned in the connecting stub near the end of the connecting stub where it is passed into the dust collector, while the other measurement position (P1) is positioned at a distance from the one measurement position.

5. A filling indicator according to claim 4, wherein the other measurement position (P1) is common to the two differential pressure measurements.

6. A filling indicator according to claim 3, wherein inside the connecting stub, a pipe (7) is arranged axially with the connecting stub, said pipe extending at its one end from the end of the connecting (6) where it is passed into the dust collector (5), and being terminated at its other end by a transverse pipe member (8).

7. A filling indicator according to claim 3, wherein a transverse pipe member (9) is additionally arranged in the connecting stub (6) at a distance from the end where the connecting stub is passed into the dust collector.

8. A filling indicator according to claim 7, wherein the length of the axial pipe (7) is at least 5 mm, preferably 50 mm.

* * * * *